United States Patent [19]

Schiel

[11] Patent Number: 4,503,765

[45] Date of Patent: Mar. 12, 1985

[54] PRESS FOR THE REMOVAL OF MOISTURE FROM WET WEBS OF FIBER MATERIAL

[75] Inventor: Christian Schiel, Heidenheim, Fed. Rep. of Germany

[73] Assignee: J. M. Voith GmbH, Heidenheim, Fed. Rep. of Germany

[21] Appl. No.: 464,646

[22] Filed: Feb. 7, 1983

[30] Foreign Application Priority Data

Feb. 17, 1982 [DE] Fed. Rep. of Germany ..... 3205664

[51] Int. Cl.[3] ..... B30B 9/24; B30B 9/20; D21F 3/00

[52] U.S. Cl. ..... 100/118; 100/121; 100/153; 100/210; 100/156; 162/358

[58] Field of Search ..... 100/118, 119, 120, 121, 100/151, 152, 153, 154, 156, 210; 162/358, 205, 361

[56] References Cited

U.S. PATENT DOCUMENTS

| | | | |
|---|---|---|---|
| 3,783,097 | 1/1974 | Justus | 100/121 |
| 4,287,021 | 9/1981 | Justus et al. | 162/358 |
| 4,427,492 | 1/1984 | Cronin | 100/153 X |

*Primary Examiner*—Peter Feldman

*Attorney, Agent, or Firm*—Albert L. Jeffers; Stephen T. Belsheim

[57] ABSTRACT

A press for applying pressure to a moving web of fiber material to squeeze water from the web by means of auxiliary belts and comprising a pressure roll, pressure shoes mounted on the periphery of a rotary carrier in circumferentially spaced relation to each other, and a pressure belt extending about the carrier and shoes. The carrier is rotated by a motor to bring any one of the shoes into an operative position adjacent the pressure roll.

6 Claims, 2 Drawing Figures

II
5
3
2
1
R1
18
20
19
12
15
6
11
10
16
17
21
7
8
13
14
R2
R3

5
4
3
2
1
6
12
9
22
23
11
10
24
14
8
25
7
21

PRESS FOR THE REMOVAL OF MOISTURE FROM WET WEBS OF FIBER MATERIAL

In the pressing of wet webs of fiber material, use is made of either (a) two rotatable rolls which are pressed towards each other and form a gap through which the web to be pressed passes, wherein the rolls are used alone or in conjunction with belts, e.g., screens or felts, or (b) a stationary pressure shoe, which replaces at least one of the two rolls and over which slides an endless pressure belt which assumes the function of the roll surface for the purpose of applying pressure to the web of fiber material or to the auxiliary dryer belts.

The latter type of press using a stationary pressure shoe offers the advantage over simple roll pressing in that, irrespective of the geometric and mechanical limitations which are imposed when rolls are used, the width of the pressing zone in the direction of movement and the change in pressure in this zone can be selected as required. For example, the pressure shoe may have a planar or concave cylindrical surface, which is not possible with a roll. This results in a circumferentially larger press gap and, without causing damage to the web of fiber material and to the auxiliary dryer belts, use can be made of greater linear forces, and correspondingly improved removal of moisture is achieved. For a given compressiblity of the arrangement comprising the web of fiber material and the auxiliary dryer belts and for a given width of the pressure shoe in the direction of movement, it is possible to establish an optimum curvature of the surface of the pressure shoe, which is so designed that the entire width of the shoe is used as a pressing zone. In this case, a higher linear force can be applied without setting up excessive thrust or pressure loading such as would lead to undesirable damage to the web of fiber material by crushing or destruction of the auxiliary dryer belts due to overstretching, crushing of parts of the fabric, or irreversible compacting of the fiber.

Unfortunately, it has been found that shoe presses and roll presses have a defect in common in that the operative circumferential length of the pressure gap and therefore the thrust and compressive loading on the web and the auxiliary dryer belts vary in the pressing zone in dependence on the behavior of the web and belts under compression. Particularly when thin webs are to be pressed instead of thick webs, for which the width of the pressing zone has to be designed, the linear force has to be reduced so as to avoid overloading in the pressing zone, which becomes shorter as a result of the lesser compressibility of the thin web. Furthermore, the auxiliary dryer belts, such as pressing belts and screens, progressively lose their elasticity and compressibility during use. Thus, the width of pressing zone diminishes continuously. If it is desired to avoid the risk of premature destruction of the belts and damage to the web of fiber material, for example, marking of the surface, or crushing, then the linear force must be continuously reduced as the compressibility of the web and belts passed through the pressing gap diminishes, with the result that the drying effect is reduced.

The present invention is concerned with the provision of a press enabling a pressure shoe to be replaced readily by a new shoe.

According to this invention, there is provided a press for applying pressure to a moving web comprising a pressure roll, at least two pressure shoes each extending axially of the roll for forming a pressure zone therewith, means whereby any selected one of the shoes can be moved selectively into an operative position to form the pressure zone with the pressure roll and into an inoperative position, and a pressure belt for engagement with the web which extends about the shoes.

Thus, two or more pressure shoes may be fitted beforehand in the press itself and in such manner that each of the pressure shoes can be moved as required into its operative position in the pressing zone. It is therefore no longer necessary for the pressure shoe in operation to be laboriously detached and extracted axially from the press and to insert the new shoe, again axially, into the press and to secure it therein. Troublesome storage of pressure shoes outside the press is also avoided. In preferred arrangements a swinging movement suffices to bring the new pressure shoe into the correct position.

Several requirements differing from each other can be met by the press of the present invention, for example, it is possible to equip the press with two or more pressure shoes having completely similar properties and a completely similar shape. A replacement movement can then be carried out when the one pressure shoe is worn out. Alternatively, when several different types of paper are to be passed at regular intervals of time through a paper-handling machine, it is possible to provide the press beforehand with shoes respectively corresponding to the specific types of paper enabling the press to be readily used to meet this requirement.

Furthermore, the reserve shoe or shoes can be so designed as to take into account the expected change in the properties of the other press components, e.g., the pressing belts and screens. As the changes affecting these other components increase with time, initially a first reserve shoe, then a second and so on, can be moved into the pressing zone. In such a case, the various shoes will have properties that differ from shoe to shoe, particularly differing radii of curvature. They may also be made of different materials and therefore have a working surface that differs from shoe to shoe.

The shoes may, of course, be incorporated in the press in such a way that they cannot only be swung out of the pressing zone, but also removed completely from the press. This may be necessary, for example, when one of the shoes becomes worn. In contrast to known presses having rotating rolls and fixed shoes, a press in accordance with the present invention may be permitted to operate without a shoe being removed from the press for replacement until it becomes necessary for other reasons to stop the machine for a fairly lengthy period.

In accordance with a further preferred feature of the invention and for the purpose of carrying out a movement of the shoes, use is advantageously made of pneumatically or fluidly actuated rotary units, the construction of which does not require to be described. With such units, a rotational movement can be carried out in a matter of seconds.

The present invention is particularly suitable in the case of such shoes that have a concave working surface for the purpose of forming a pressure gap which is long in the direction of movement of the material under treatment. Its use is possible, however, with any other form of shoe.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
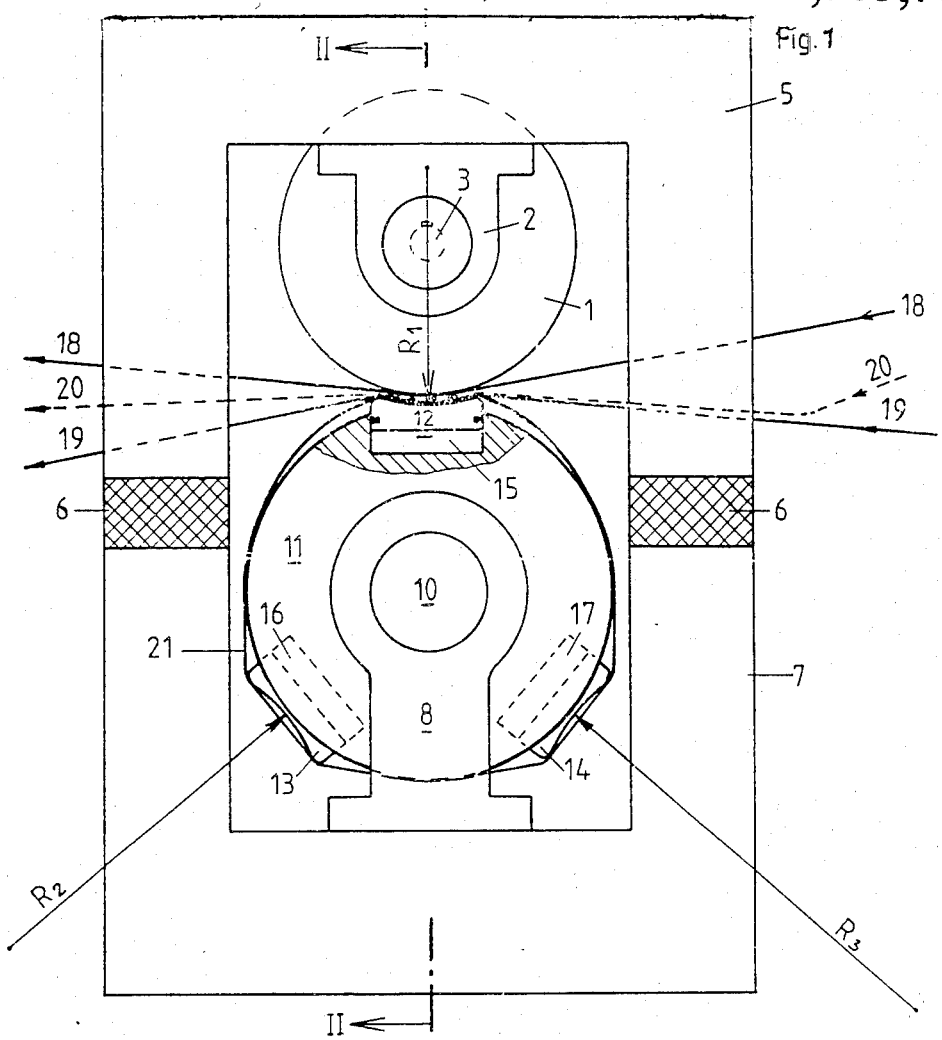
FIG. 1 is a side elevational view of a shoe-type press according to the present invention.
Figure 2:
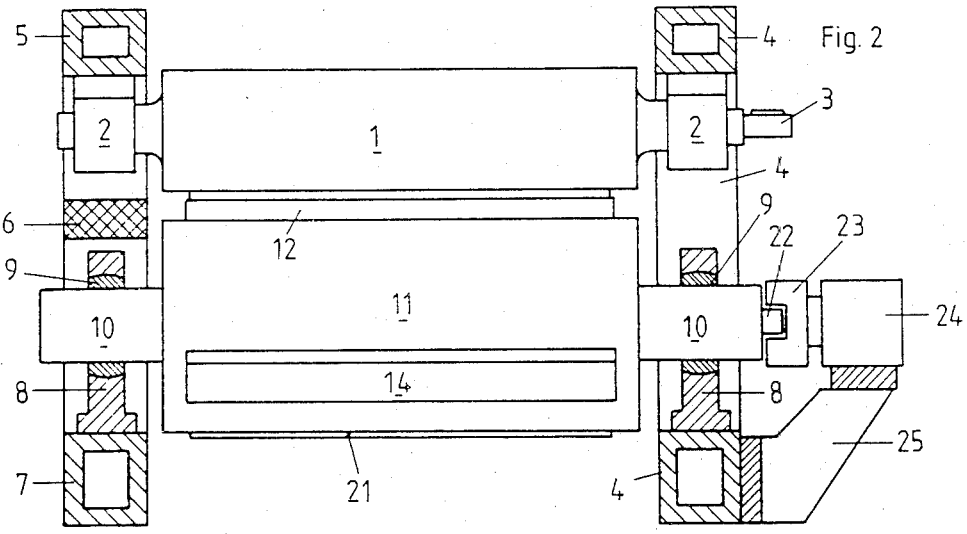
FIG. 2 is a cross sectional view of FIG. 1 taken along line II—II of FIG. 1 and viewed in the direction of the arrows.

Referring to the figures, an upper roll 1 is mounted on a drive shaft 3 and rotates in bearing blocks 2. The bearing block 2 at the drive side is supported in a frame 4, while the block 2 at the other, guide side is mounted in a frame part 5 which is connected to a second frame part 7 by means of removable intermediate elements 6. Mounted opposite roll 1 are bearing blocks 8, which are respectively secured to frame part 7 at the guide side and to the lower part of frame 4 at the drive side. Mounted in self-aligning bearings 9 are the trunnions 10 of carrier 11, on the surface of which facing roll 1 are mounted pressure shoes 12, 13 and 14 having operating surfaces of radii $R_1$, $R_2$, and $R_3$ respectively. In the construction illustrated, pressure shoes 12, 13, and 14 are in the form of rectangular plungers mounted in cylinders 15, 16, and 17, respectively, extending over the width of the machine, and cylinders 15, 16, and 17 are pressurized by means of oil or other fluid. Each of the plungers, e.g., pressure shoe 12, when disposed directly opposite roll 1, is pressed against roll 1 by the pressure in the associated cylinder, cylinder 15 for pressure shoe 12, to generate the required linear force. Two auxiliary dryer belts 18 and 19, which may be wet felts or screens, web 20 of fibrous material and pressure belt 21 extend through the pressing zone between pressure shoe 12 and roll 1. Pressure belt 21 is impermeable to liquid and is lubricated with oil on its inner surface by means of devices not illustrated. Outside the pressing zone, pressure belt 21 extends about the periphery of carrier 11 and shoes 13 and 14. Drive is imparted through upper roll 1, and pressure belt 21 is entrained by friction through belts 18 and 19 and by means of web 20 of fibrous material. For the purpose of imparting a rotational movement to carrier 11, one of its trunions 10 has a dog 22 secured to it and a claw 23 connected to a rotary drive mechanism 24 engages dog 22. Rotary drive mechanism 24, for example, a geared motor, is secured on bracket 25 on frame 4 and is used to rotate carrier 11 when another pressure shoe 13 or 14 is to be brought into working position against roll 1. Alternatively, mechanism 24 could be a pneumatically or fluidly actuated rotary unit, as earlier described.

Belts 18 and 19 can extend about roll 1 and carrier 11 either in wide loops or relatively closely.

While this invention has been described as having a preferred embodiment, it will be understood that it is capable of further modifications. This application is therefor intended to cover any variations, uses, or adaptations of the invention following the general principles thereof, and including such departures from the present disclosure as come within known or customary practice in the art to which this invention pertains and fall within the limits of the appended claims.

What is claimed is:

1. A press adapted for applying pressure to a moving web, comprising:

a pressure roll, at least two pressure shoes respectively extending axially of said pressure roll only one of said pressure shoes at a time being closely spaced near said pressure roll to form a single pressure zone therewith, means for selectively moving a respective one of said pressure shoes between an operative position forming said single pressure zone with said pressure roll and an inoperative position away from said pressure roll, and a pressure belt adapted to engage said web which extends about said pressure shoes.

2. The press of claim 1 wherein at least one of said pressure shoes is shaped differently from the other said pressure shoes.

3. The press of claim 1 wherein a working surface of at least one of said pressure shoes has a radius of curvature different from the other said pressure shoes.

4. The press of claim 1 wherein said moving means is a rotary carrier having said pressure shoes disposed thereon in circumferentially spaced relation to each other.

5. The press of claim 4 further comprising pneumatic actuating means for rotating said rotary carrier.

6. The press of claim 4 further comprising fluid actuating means for rotating said rotary carrier.

* * * * *